US005423374A

United States Patent [19]

Miller et al.

[11] Patent Number: 5,423,374

[45] Date of Patent: Jun. 13, 1995

[54] HEAT EXCHANGER FOR FLUE GAS

[76] Inventors: Henry J. Miller; Susie Miller, both of 24956 Walters Rd., Centerville, Mich. 49032

[21] Appl. No.: 242,332

[22] Filed: May 13, 1994

[51] Int. Cl.[6] ..... F24C 15/32; F24J 3/00

[52] U.S. Cl. ..... 165/47; 165/102; 165/901; 237/55

[58] Field of Search ..... 165/47, 102, 901, 909; 237/55

[56] References Cited

U.S. PATENT DOCUMENTS

| | | | |
|---|---|---|---|
| 17,750 | 7/1857 | Sawyer | 237/55 |
| 608,935 | 8/1898 | Vernier | 165/102 |
| 1,797,909 | 3/1931 | Ellsdorf | 165/901 |
| 1,895,075 | 1/1933 | Horton | 165/901 |

FOREIGN PATENT DOCUMENTS

| | | | |
|---|---|---|---|
| 622383 | 5/1927 | France | 165/102 |

*Primary Examiner*—John K. Ford

[57] ABSTRACT

An improved heat exchanger containing a hollow cylindrical pipe casing having a plurality of apertures formed on the surface. A lower elbow pipe is secured to a stove outlet pipe and to the hollow cylindrical pipe casing. The lower elbow pipe functions to receive hot air discharged from a stove. A plurality of receiving elbow pipes are positioned within the apertures that are formed in the hollow cylindrical pipe casing that function to receive cool air from an outside source. A plurality of inner U-shaped pipes are positioned within the hollow cylindrical pipe casing and are secured to a corresponding receiving elbow pipe. Each inner U-shaped pipes is positioned within one of the plurality of apertures that is formed in the hollow cylindrical pipe casing. A plurality of outlet pipes are also contained in the device and are secured to a one of the corresponding plurality of inner U-shaped pipes. Each outlet pipes functions to release warmed air into a room. A chimney pipe within the device is secured to the hollow cylindrical pipe casing by a fastening means and is secured to a chimney flue functioning to move hot air upward to draw cool air into the two receiving elbow pipes.

1 Claim, 4 Drawing Sheets

FIG 1
PRIOR ART
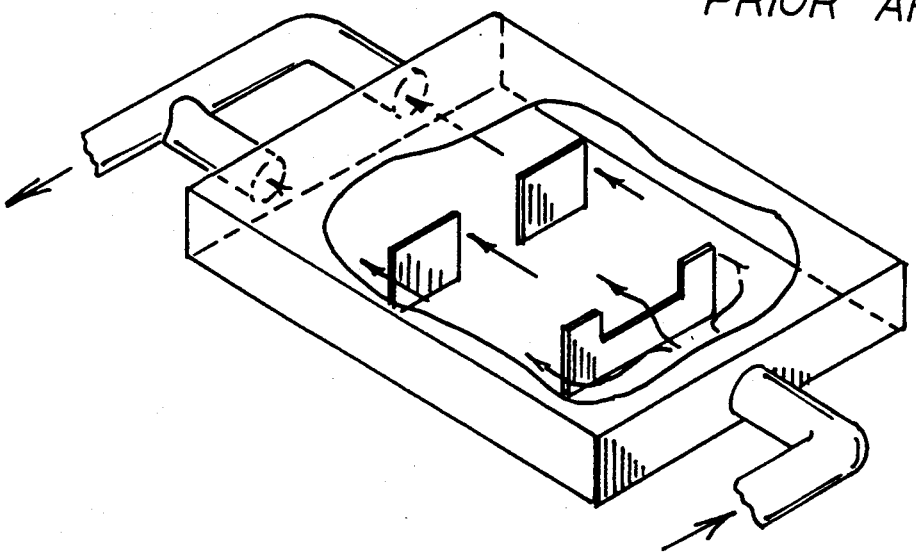
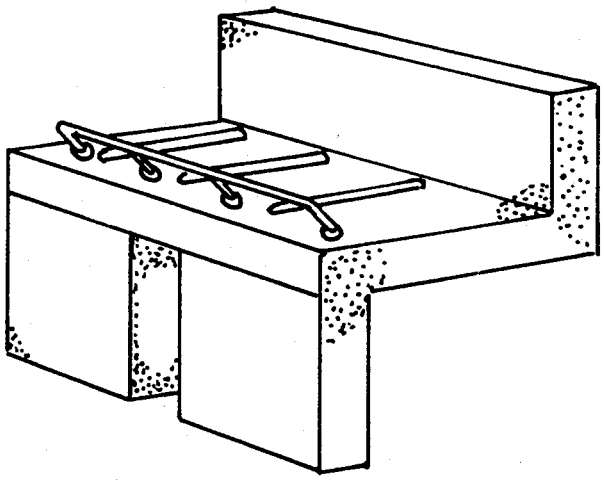
FIG 2
PRIOR ART

FIG 5
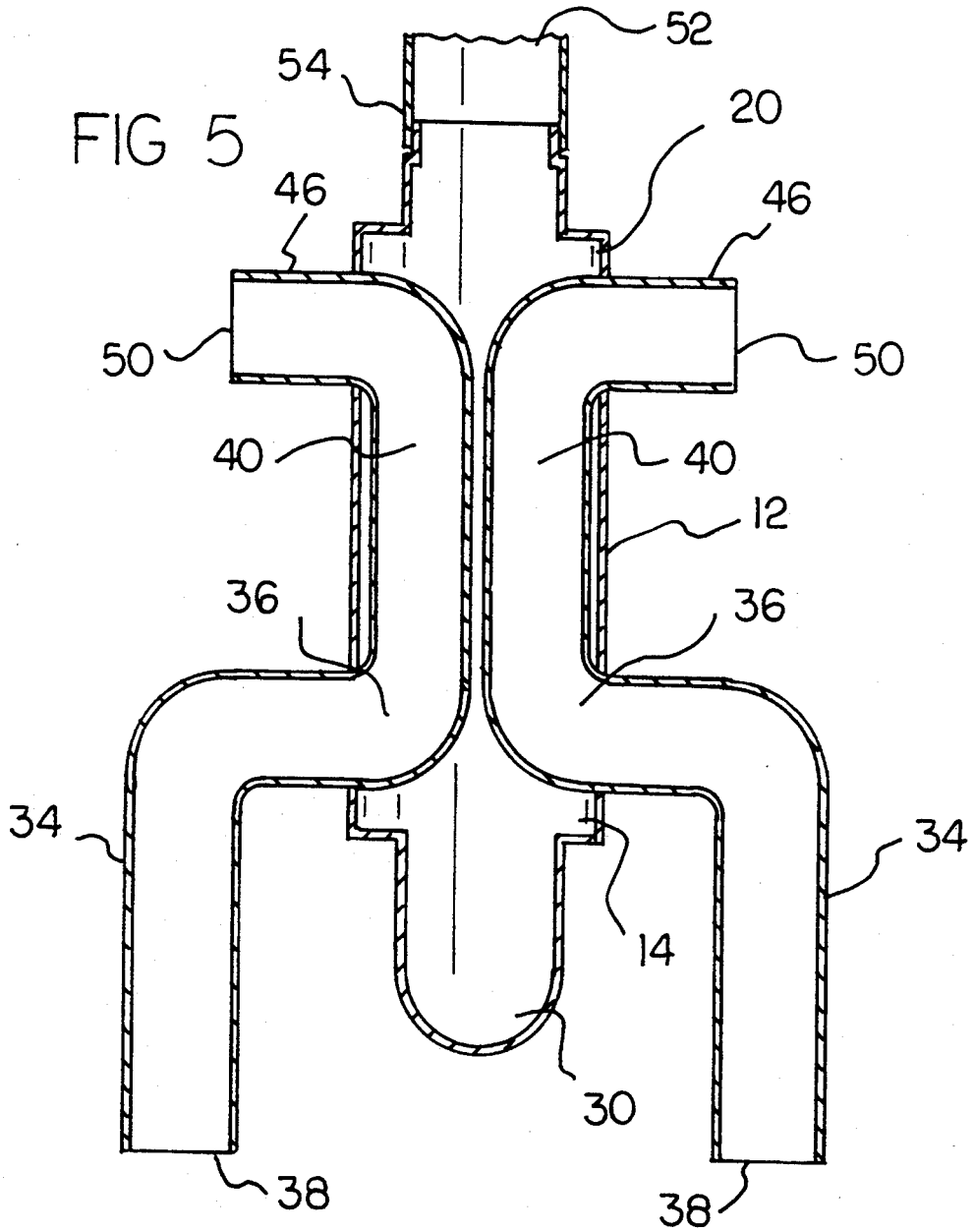
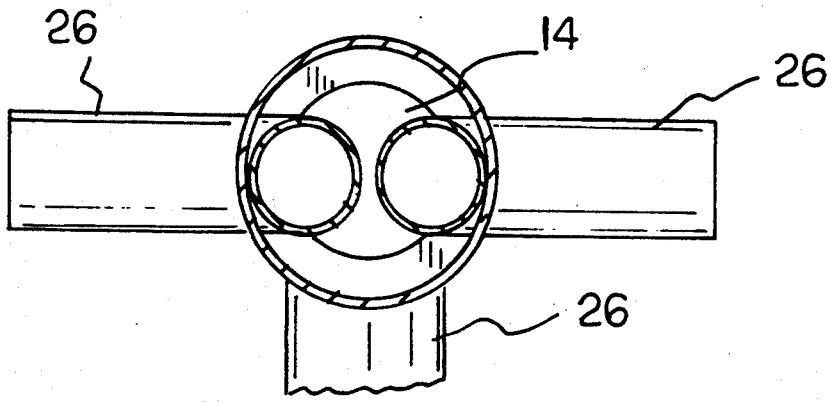
FIG 6

HEAT EXCHANGER FOR FLUE GAS

BACKGROUND OF THE INVENTION

1. Field of the Invention

The present invention relates to a heat exchanger and more particularly pertains to recovering heat which escapes through a flue pipe from a boiler or a hot air furnace and transferring some of the heat from a hotter source to a colder source with a heat exchanger.

2. Description of the Prior Art

The use of fireplace heat exchangers is known in the prior art. More specifically, fireplace heat exchangers heretofore devised and utilized for the purpose of discharging heat are known to consist basically of familiar, expected and obvious structural configurations, notwithstanding the myriad of designs encompassed by the crowded prior art which have been developed for the fulfillment of countless objectives and requirements.

By way of example, Furman U.S. Pat. No. 5,139,012 et al. discloses a fireplace heat exchanger.

Davidson U.S. Pat. No. Des. 273,323 discloses the design of a fireplace heat exchanger.

Scala U.S. Pat. No. 5,038,754 discloses a fireplace heat exchanger.

Stora U.S. Pat. No. 4,332,236 et al. discloses a fireplace heat exchanger.

Hartley U.S. Pat. No. Des. 253,067 discloses a fireplace heat exchanger.

While these devices fulfill their respective, particular objective and requirements, the aforementioned patents do not describe a heat exchanger that recovering heat which escapes through a flue pipe from a boiler or a hot air furnace and transferring some of the heat from a hotter source to a colder source.

In this respect, the heat exchanger according to the present invention substantially departs from the conventional concepts and designs of the prior art, and in doing so provides an apparatus primarily developed for the purpose of recovering heat which escapes through a flue pipe from a boiler or a hot air furnace and transferring some of the heat from a hotter source to a colder source.

Therefore, it can be appreciated that there exists a continuing need for a new and improved heat exchanger which can be used for recovering heat which escapes through a flue pipe from a boiler or a hot air furnace and transferring some of the heat from a hotter source to a colder source. In this regard, the present invention substantially fulfills this need.

SUMMARY OF THE INVENTION

In the view of the foregoing disadvantages inherent in the known types of fireplace heat exchangers now present in the prior art, the present invention provides an improved heat exchanger. As such, the general purpose of the present invention, which will be described subsequently in greater detail, is to provide a new and improved heat exchanger and method which has all the advantages of the prior art and none of the disadvantages.

To attain this, the present invention essentially comprises a hollow cylindrical pipe casing having a first open end, a second open end, a lower end, an upper end, and an intermediate extent therebetween. Two apertures are formed in the lower end that are diametrically opposed to each other. Two apertures are formed in the upper end that are diametrically opposed to each other.

The device also contains a lower elbow pipe having a first open end and a second open end. The first open end is secured to a stove outlet pipe. The second open end is secured to the second open end of the hollow cylindrical pipe casing by a fastening means. The lower elbow pipe functions to receive hot air discharged from a stove. Two receiving elbow pipes are another component of the device. Each receiving elbow pipe has an open first end and an open second end. Each open first end is positioned within one of the two apertures that is formed in the lower end of the hollow cylindrical pipe casing. Each open second end functions to receive cool air from an outside source. Two inner U-shaped pipes are positioned within the hollow cylindrical pipe casing. Each of the inner U-shaped pipes has an open first end, an open second end, and an intermediate extent therebetween. Each open first end is secured to the corresponding open first end of one of the two receiving elbow pipes. Each open second end of the inner U-shaped pipes is positioned within one of the two apertures that are formed in the upper end of the hollow cylindrical pipe casing. The device contains two outlet pipes. Each outlet pipe has an open first end and a open second end. Each open first end is secured to the corresponding open second end of one of the two inner U-shaped pipes. Each open second end of the outlet pipes functions to release warmed air into a room. The last component of the device is a chimney pipe having an open first end and an open second end. The open first end is secured to the open second end of the hollow cylindrical pipe casing by a fastening means. The open second end is secured to a chimney flue functioning to move hot air upward to draw cool air into the two receiving elbow pipes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved heat exchanger which has all the advantages of the prior art fireplace heat exchangers and none of the disadvantages.

It is another object of the present invention to provide a new and improved heat exchanger which may be easily and efficiently manufactured and marketed.

It is a further object of the present invention to provide a new and improved heat exchanger which is of durable and reliable construction.

An even further object of the present invention is to provide a new and improved heat exchanger which is susceptible of a low cost of manufacture with regard to both materials and labor, and which accordingly is then susceptible of low prices of sale to the consuming public, thereby making such a heat exchanger economically available to the buying public.

Still yet another object of the present invention is to provide a new and improved heat exchanger which provides in the apparatuses and methods of the prior art some of the advantages thereof, while simultaneously overcoming some of the disadvantages normally associated therewith.

Even still another object of the present invention is to provide a new and improved heat exchanger for recovering heat which escapes through a flue pipe from a boiler or a hot air furnace and transferring some of the heat from a hotter source to a colder source.

Lastly, it is an object of the present invention to provide a heat exchanger containing a hollow cylindrical pipe casing having a first open end, a second open end, and an intermediate extent therebetween. A plurality of apertures are formed in the intermediate extent. The device also contains a lower elbow pipe having a first open end and a second open end. The first open end is secured to a stove outlet pipe. The second open end is secured to the second open end of the hollow cylindrical pipe casing by a fastening means. The lower elbow pipe functions to receive hot air discharged from a stove. A plurality of receiving elbow pipes are contained within the device. Each receiving elbow pipe has an open first end and an open second end. Each open first end is positioned within one of the apertures that is formed in the lower end of the hollow cylindrical pipe casing. Each open second end functions to receive cool air from an outside source. A plurality of inner U-shaped pipes are positioned within the hollow cylindrical pipe casing. Each of the inner U-shaped pipes has an open first end, an open second end, and an intermediate extent therebetween. Each open first end is secured to the corresponding open first end of a corresponding receiving elbow pipe. Each open second end of the inner U-shaped pipes is positioned within one of the plurality of apertures that is formed in the intermediate extent of the hollow cylindrical pipe casing.

A plurality of outlet pipes are also contained in the device. Each outlet pipe has an open first end and a open second end. Each open first end is secured to a corresponding open second end of one of the plurality of inner U-shaped pipes. Each open second end of the outlet pipes functions to release warmed air into a room. A chimney pipe within the device has an open first end and an open second end. The open first end is secured to the open second end of the hollow cylindrical pipe casing by a fastening means. The open second end is secured to a chimney flue functioning to move hot air upward to draw cool air into the two receiving elbow pipes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a prior art enlarged perspective view showing the heat exchanger having its top panel broken away to expose the special arrangement of baffles.

FIG. 2 is a prior art perspective view of a fireplace heat exchanger.

FIG. 5 is a cross-sectional view of the present invention as seen along line 5—5 of FIG. 4.

FIG. 6 is a cross-sectional view of the present invention as seen along line 6—6 of FIG. 3.

The same reference numerals refer to the same parts through the various Figures.

DESCRIPTION OF THE PREFERRED EMBODIMENT

Figure 3:
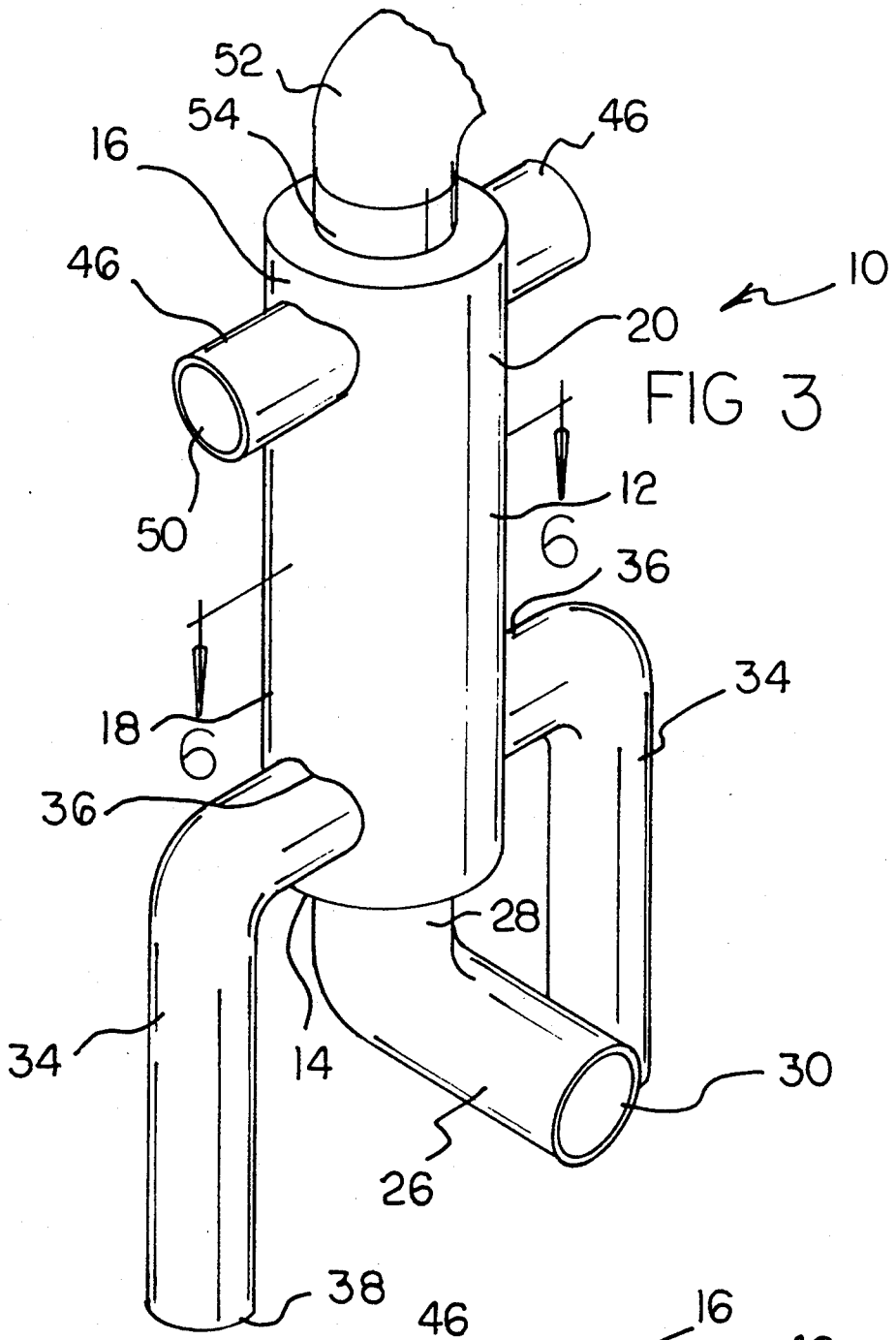
FIG. 3 is a perspective view of the preferred embodiment of the heat exchanger constructed in accordance with the principles of the present invention.
Figure 4:
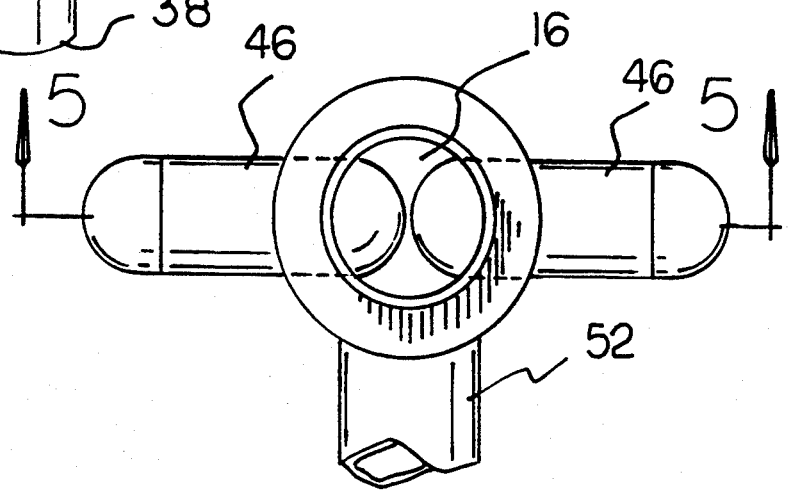
FIG. 4 is a bottom plan view of the present invention.
Figure 7:
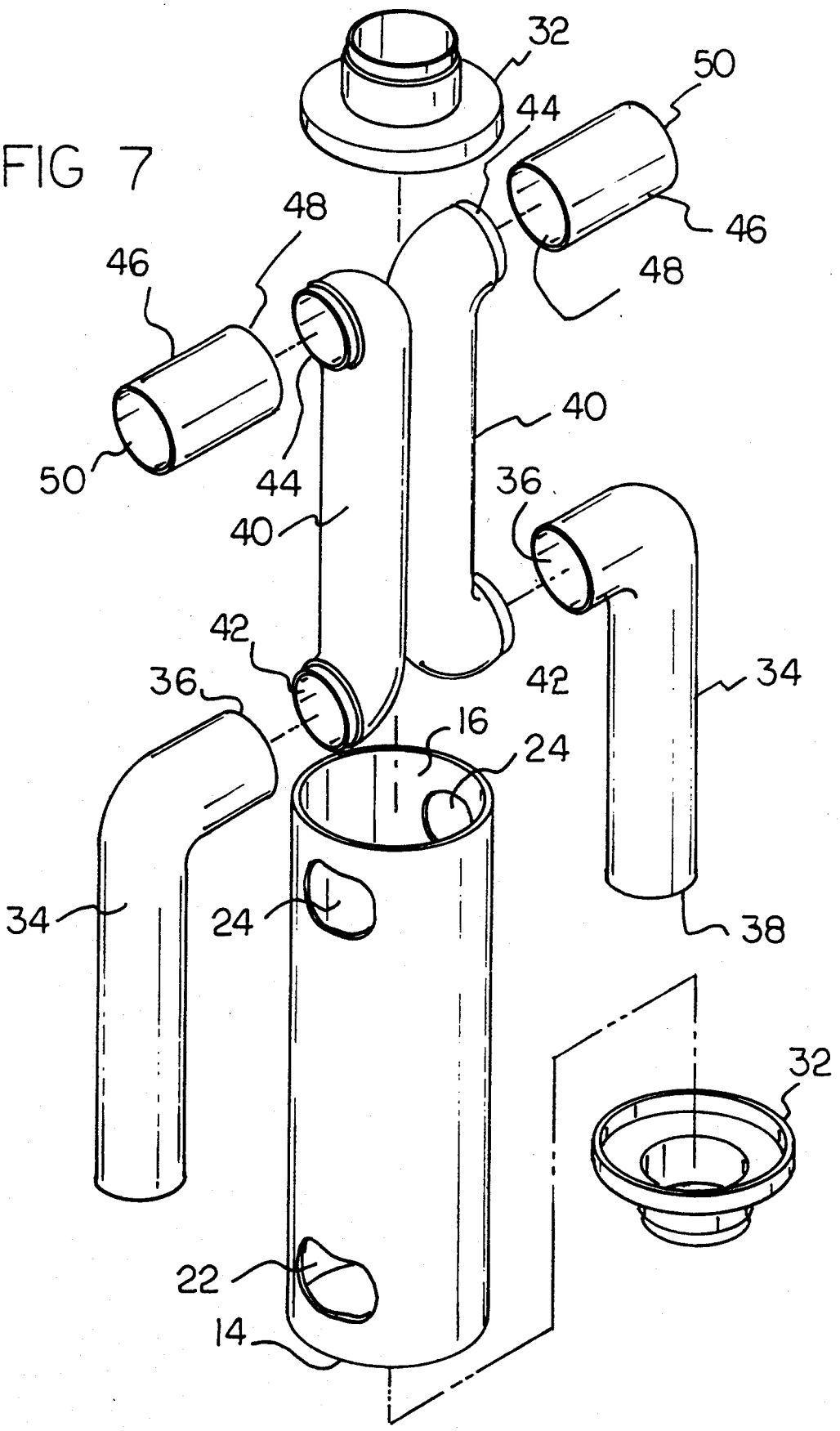
FIG. 7 is an exploded perspective view of the present invention.

With reference now to the drawings, and in particular, to FIG. 1 thereof, the preferred embodiment of the new and improved heat exchanger embodying the principles and concepts of the present invention and generally designated by the reference number 10 will be described.

Specifically, it will be noted in the various Figures that the device 10 relates to a heat exchanger for recovering heat which escapes through a flue pipe from a boiler or a hot air furnace and transfers some of the heat from a hotter source to a colder source. In its broadest context, the device consists of a hollow cylindrical pipe casing, a lower elbow pipe, two receiving elbow pipes, two inner U-shaped pieces, two outlet pipes, and a chimney pipe.

The device 10 contains a hollow cylindrical pipe casing 12 having a first open end 14, a second open end 16, a lower end 18, an upper end 20, and an intermediate extent therebetween. Two apertures 22 are formed in the lower end 18 that are diametrically opposed to each other. Two apertures 24 are formed in the upper end 20 that are diametrically opposed to each other.

The device 10 also contains a lower elbow pipe 26 having a first open end 28 and a second open end 30. The first open end 28 is secured to a stove outlet pipe. The stove outlet pipe releases hot air that is heated within a stove. The second open end 30 is secured to the second open end 16 of the hollow cylindrical pipe casing 12 by a fastening means 32. The lower elbow pipe 26 functions to receive hot air discharged from a stove.

Two receiving elbow pipes 34 are another component of the device. Each receiving elbow pipe 34 has an open first end 36 and an open second end 38. Each open first end 34 is positioned within one of the two apertures 22 that is formed in the lower end 18 of the hollow cylindrical pipe casing 12. Each open second end 38 functions to receive cool air from an outside source. The outside source is the room in which the stove is located and the cool air circulates.

Two inner U-shaped pipes 40 are positioned within the hollow cylindrical pipe casing 12. Each of the inner U-shaped pipes 40 has an open first end 42, an open second end 44, and an intermediate extent therebetween. Each open first end 42 is secured to the corresponding open first end 36 of one of the two receiving elbow pipes 34. Each open second end 44 of the inner U-shaped pipes 40 is positioned within one of the two apertures 24 that are formed in the upper end 20 of the hollow cylindrical pipe casing 12.

The device 10 contains two outlet pipes 46. Each outlet pipe 46 has an open first end 48 and a open second end 50. Each open first end 48 is secured to the corresponding open second end 44 of one of the two inner U-shaped pipes 40. Each open second end 50 of the outlet pipes 46 functions to release warmed air into a room. Thus allowing the room to be heated by the stove.

The last component of the device 10 is a chimney pipe 52 having an open first end 54 and an open second end 56. The open first end 54 is secured to the open second end 16 of the hollow cylindrical pipe casing 12 by a fastening means 32. The open second end 56 is secured to a chimney flue functioning to move hot air upward to draw cool air into the two receiving elbow pipes 34.

The present invention was designed to recover heat which escapes through a flue pipe from a boiler or a hot air furnace. Regardless of how efficiently this units operate, or whether they are heated by oil or gas, the byproducts of combustion from the burning fuels are discharged into a flue pipe. This is directed up a chimney where they are released into the atmosphere. Unfortunately, this air is at a very high temperature, but the heat energy is simply lost.

The present invention is a device which transfers some of the heat from the hotter source to a colder source, without being mixed or coming into direct contact with each other. These units can also be used for cooling purposes. In its simplest form, the present invention is a vessel which contains pipes through which the hot medium flows. The pipes are surrounded by a cooler medium which becomes heated by contact with, and radiation from, the hot medium.

This invention is added in the flue gas piping before the connection to the chimney flue. It consists of a larger diameter length of pipe, with end connections that match the size of the flue pipe. One or more smaller pipes pass through the inside of the larger and the assembly becomes a heat exchanger. Cooler air is introduced at one end of the unit and picks up some of the heat from the flue gases before it exits through the opposite end of the present invention. No blowers are needed, the air flow through the smaller pipes is caused by convection and is heated within the unit. Cold air in the room is warmed in the unit and then returned into the room to provide a substantial amount of heat. The present invention is constructed from stove pipe materials, such as aluminum or galvanized steel. This unit is safe to use because the flue gases are confined to the flue pipe. Of course, flue pipes should be checked frequently to ensure that they do not leak.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A new and improved heat exchanger for recovering heat which escapes through a flue pipe from a boiler or a hot air furnace and transfers some of the heat from a hotter source to a colder source comprising, in combination:

a hollow cylindrical pipe casing having a first open end, a second open end, a lower end, an upper end, and an intermediate extent therebetween, two apertures formed in the lower end being diametrically opposed to each other, two apertures formed in the upper end being diametrically opposed to each other;

a lower elbow pipe having a first open end and a second open end, the first open end secured to a stove outlet pipe, the second open end secured to the second open end of the hollow cylindrical pipe casing by a fastening means, the lower elbow pipe functioning to receive hot air discharged from a stove;

two receiving elbow pipes, each receiving elbow pipe having an open first end and an open second end, each open first end positioned within one of the two apertures formed in the lower end of the hollow cylindrical pipe casing, each open second end functioning to receive cool air from an outside source;

two inner U-shaped pipes positioned within the hollow cylindrical pipe casing and spaced from each other and spaced from the hollow cylindrical pipe casing along their lengths to allow a free flow of air entirely around the exteriors of the inner U-shaped,pipes, each of the inner U-shaped pipes having an open first end, an open second end, and an intermediate extent therebetween, each open first end secured to the corresponding open first end of one of the two receiving elbow pipes, each open second end of the inner U-shaped pipes positioned within the two apertures formed in the upper end of the hollow cylindrical pipe casing;

two outlet pipes, each outlet pipe having an open first end and an open second end, each open first end secured to the corresponding open second end of the two inner U-shaped pipes, each open second end of the outlet pipes functioning to release warmed air into a room; and a chimney pipe having an open first end and an open second end, the open first end secured to the open second end of the hollow cylindrical pipe casing by a fastening means, the open second end secured to a chimney flue functioning to move hot air upward to draw cool air into the two receiving elbow pipes.

* * * * *